US008677961B2

(12) United States Patent
Fischer

(10) Patent No.: US 8,677,961 B2
(45) Date of Patent: Mar. 25, 2014

(54) HARMONIC DRIVE CAMSHAFT PHASER WITH LOCK PIN FOR SELECTIVLEY PREVENTING A CHANGE IN PHASE RELATIONSHIP

(75) Inventor: Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 300 days.

(21) Appl. No.: 13/184,975

(22) Filed: Jul. 18, 2011

(65) Prior Publication Data

US 2013/0019825 A1 Jan. 24, 2013

(51) Int. Cl.
*F01L 1/34* (2006.01)

(52) U.S. Cl.
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 5,163,872 | A * | 11/1992 | Niemiec et al. | 464/2 |
| 5,417,186 | A | 5/1995 | Elrod et al. | |
| 5,816,204 | A * | 10/1998 | Moriya et al. | 123/90.17 |
| 6,257,186 | B1 | 7/2001 | Heer | |
| 6,328,006 | B1 | 12/2001 | Heer | |
| 7,100,556 | B2 * | 9/2006 | Sugiura | 123/90.17 |
| 7,278,386 | B2 * | 10/2007 | Hori et al. | 123/90.17 |
| 7,421,990 | B2 * | 9/2008 | Taye et al. | 123/90.17 |
| 7,458,351 | B2 * | 12/2008 | Takenaka et al. | 123/90.17 |
| 7,578,273 | B2 * | 8/2009 | Meintschel et al. | 123/90.17 |
| 8,151,751 | B2 * | 4/2012 | Shiino et al. | 123/90.17 |
| 8,322,318 | B2 * | 12/2012 | David et al. | 123/90.17 |
| 2005/0022765 | A1 * | 2/2005 | Takenaka et al. | 123/90.17 |
| 2008/0047511 | A1 * | 2/2008 | Taye et al. | 123/90.17 |
| 2008/0053389 | A1 | 3/2008 | Schafer et al. | |
| 2009/0199797 | A1 * | 8/2009 | Schafer et al. | 123/90.17 |
| 2009/0293826 | A1 * | 12/2009 | Lancefield et al. | 123/90.17 |
| 2010/0024754 | A1 * | 2/2010 | Kameda et al. | 123/90.17 |
| 2010/0064998 | A1 * | 3/2010 | Hale et al. | 123/90.17 |
| 2011/0000450 | A1 * | 1/2011 | Shiino et al. | 123/90.17 |
| 2011/0030631 | A1 | 2/2011 | David et al. | |
| 2011/0030632 | A1 * | 2/2011 | David et al. | 123/90.17 |
| 2011/0277713 | A1 * | 11/2011 | David et al. | 123/90.15 |
| 2011/0303169 | A1 * | 12/2011 | Nakamura et al. | 123/90.15 |
| 2011/0315102 | A1 * | 12/2011 | David et al. | 123/90.15 |
| 2012/0024247 | A1 * | 2/2012 | David et al. | 123/90.17 |
| 2012/0145104 | A1 * | 6/2012 | David et al. | 123/90.17 |
| 2012/0186548 | A1 * | 7/2012 | David et al. | 123/90.17 |
| 2012/0255509 | A1 * | 10/2012 | Lichti et al. | 123/90.15 |
| 2012/0291729 | A1 * | 11/2012 | David et al. | 123/90.15 |
| 2012/0312258 | A1 * | 12/2012 | Kimus et al. | 123/90.15 |
| 2012/0318219 | A1 * | 12/2012 | Fischer | 123/90.15 |
| 2013/0019825 | A1 * | 1/2013 | Fischer | 123/90.15 |
| 2013/0081587 | A1 * | 4/2013 | David et al. | 123/90.17 |

* cited by examiner

*Primary Examiner* — Thomas Denion
*Assistant Examiner* — Steven D Shipe
(74) *Attorney, Agent, or Firm* — Thomas N. Twomey

(57) ABSTRACT

A camshaft phaser includes a housing. A harmonic gear drive unit is disposed within the housing and includes a circular spline and a dynamic spline, a flexspline disposed within the circular spline and the dynamic spline, a wave generator disposed within the flexspline, and a rotational actuator connectable to the wave generator. One of the circular spline and the dynamic spline is fixed to the housing. A hub is rotatably disposed within the housing and attachable to the camshaft and fixed to the other of the circular spline and the dynamic spline. A lock pin is provided for selective engagement with a lock pin seat such that engagement of the lock pin with the lock pin seat prevents relative rotation between the circular spline and the dynamic spline.

11 Claims, 5 Drawing Sheets

HARMONIC DRIVE CAMSHAFT PHASER WITH LOCK PIN FOR SELECTIVLEY PREVENTING A CHANGE IN PHASE RELATIONSHIP

TECHNICAL FIELD OF INVENTION

The present invention relates to an electric variable camshaft phaser (eVCP) which uses an electric motor and a harmonic drive unit to vary the phase relationship between a crankshaft and a camshaft in an internal combustion engine; more particularly, to an eVCP with a lock pin for selectively preventing a change in phase relationship between the crankshaft and the camshaft at a predetermined phase relationship.

BACKGROUND OF INVENTION

Camshaft phasers for varying the timing of combustion valves in internal combustion engines are well known. A first element, known generally as a sprocket element, is driven by a chain, belt, or gearing from an engine's crankshaft. A second element, known generally as a camshaft plate, is mounted to the end of an engine's camshaft. A common type of camshaft phaser used by motor vehicle manufactures is known as a vane-type camshaft phaser. U.S. Pat. No. 7,421,989 shows a typical vane-type camshaft phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the phase relationship of the rotor relative to the stator, as required to meet current or anticipated engine operating conditions. In order to selectively prevent a change of angular position of the rotor relative to the stator at a predetermined location, a lock pin is provided in one of the vanes which selectively engages a lock pin seat provided in an element fixed to the stator. Preventing a change of angular position of the rotor relative to the stator using the lock pin may be desired, for example, when the internal combustion is being shut down or started up and pressurized oil is not sufficiently available to maintain a desired angular position of the rotor relative to the stator.

While vane-type camshaft phasers are effective and relatively inexpensive, they do suffer from drawbacks. First, at low engine speeds, oil pressure tends to be low, and sometimes unacceptable. Therefore, the response of a vane-type camshaft phaser may be slow at low engine speeds. Second, at low environmental temperatures, and especially at engine start-up, engine oil displays a relatively high viscosity and is more difficult to pump, therefore making it more difficult to quickly supply engine oil to the vane-type camshaft phaser. Third, using engine oil to drive the vane-type camshaft phaser is parasitic on the engine oil system and can lead to requirement of a larger oil pump. Fourth, for fast actuation, a larger engine oil pump may be necessary, resulting in additional fuel consumption by the engine. Lastly, the total amount of phase authority provided by vane-type camshaft phasers is limited by the amount of space between adjacent vanes and lobes. A greater amount of phase authority may be desired than is capable of being provided between adjacent vanes and lobes. For at least these reasons, the automotive industry is developing electrically driven camshaft phasers.

One type of electrically driven camshaft phaser being developed is shown in U.S. patent application Ser. No. 12/536,575; U.S. patent application Ser. No. 12/844,918; U.S. patent application Ser. No. 12/825,806; U.S. patent application Ser. No. 12/848,599; U.S. patent application Ser. No. 12/965,057; U.S. patent application Ser. No. 13/102,138; U.S. patent application Ser. No. 13/112,199; and U.S. patent application Ser. No. 13/155,685; which are commonly owned by Applicant and incorporated herein by reference in their entirety. The electrically driven camshaft phaser is an electric variable camshaft phaser (eVCP) which comprises a flat harmonic drive unit having a circular spline and a dynamic spline linked by a common flexspline within the circular and dynamic splines, and a single wave generator disposed within the flexspline. The circular spline is connectable to either of an engine camshaft or an engine crankshaft driven rotationally and fixed to a housing, the dynamic spline being connectable to the other thereof. The wave generator is driven selectively by an electric motor to cause the dynamic spline to rotate past the circular spline, thereby changing the phase relationship between the crankshaft and the camshaft. Unlike vane-type camshaft phasers which rely on pressurized oil to change the angular position of the rotor relative to the stator and therefore the phase relationship of the crankshaft relative to the camshaft, the eVCP uses the electric motor to change and hold the phase relationship of the crankshaft relative to the camshaft when the internal combustion engine is running, shutting down, and restarting. However, a variation in the phase relationship of the crankshaft to the camshaft may occur until the system relearns the phase relationship of the crankshaft relative to the camshaft when the internal combustion engine is restarting. Consequently, it may be desirable to have a means for positively preventing a change in phase relationship of the eVCP, thereby guaranteeing a known phase relationship of the crankshaft relative to camshaft and eliminating the need to relearn the phase relationship of the crankshaft relative to the camshaft.

What is needed is an eVCP with means for preventing a change in phase relationship between the crankshaft and the camshaft; more particularly, what is needed is an eVCP with a lock pin for preventing rotation of an input member of the eVCP relative to an output member of the eVCP.

SUMMARY OF THE INVENTION

Briefly described, a camshaft phaser is provided for controllably varying the phase relationship between a crankshaft and a camshaft in an internal combustion engine. The camshaft phaser includes a housing having a longitudinal axis and a harmonic gear drive unit is disposed therein. The harmonic gear drive unit includes a circular spline and a dynamic spline, a flexspline disposed within the circular spline and the dynamic spline, a wave generator disposed within the flexspline, and a rotational actuator connectable to the wave generator. One of the circular spline and the dynamic spline is fixed to the housing in order to prevent relative rotation therebetween. A hub is rotatably disposed within the housing and attachable to the camshaft and fixed to the other of the circular spline and the dynamic spline in order to prevent relative rotation therebetween. A lock pin is provided for selective engagement with a lock pin seat such that engagement of the lock pin with the lock pin seat prevents relative rotation between the circular spline and the dynamic spline.

BRIEF DESCRIPTION OF DRAWINGS

This invention will be further described with reference to the accompanying drawings in which.

DETAILED DESCRIPTION OF INVENTION

Figure 1:
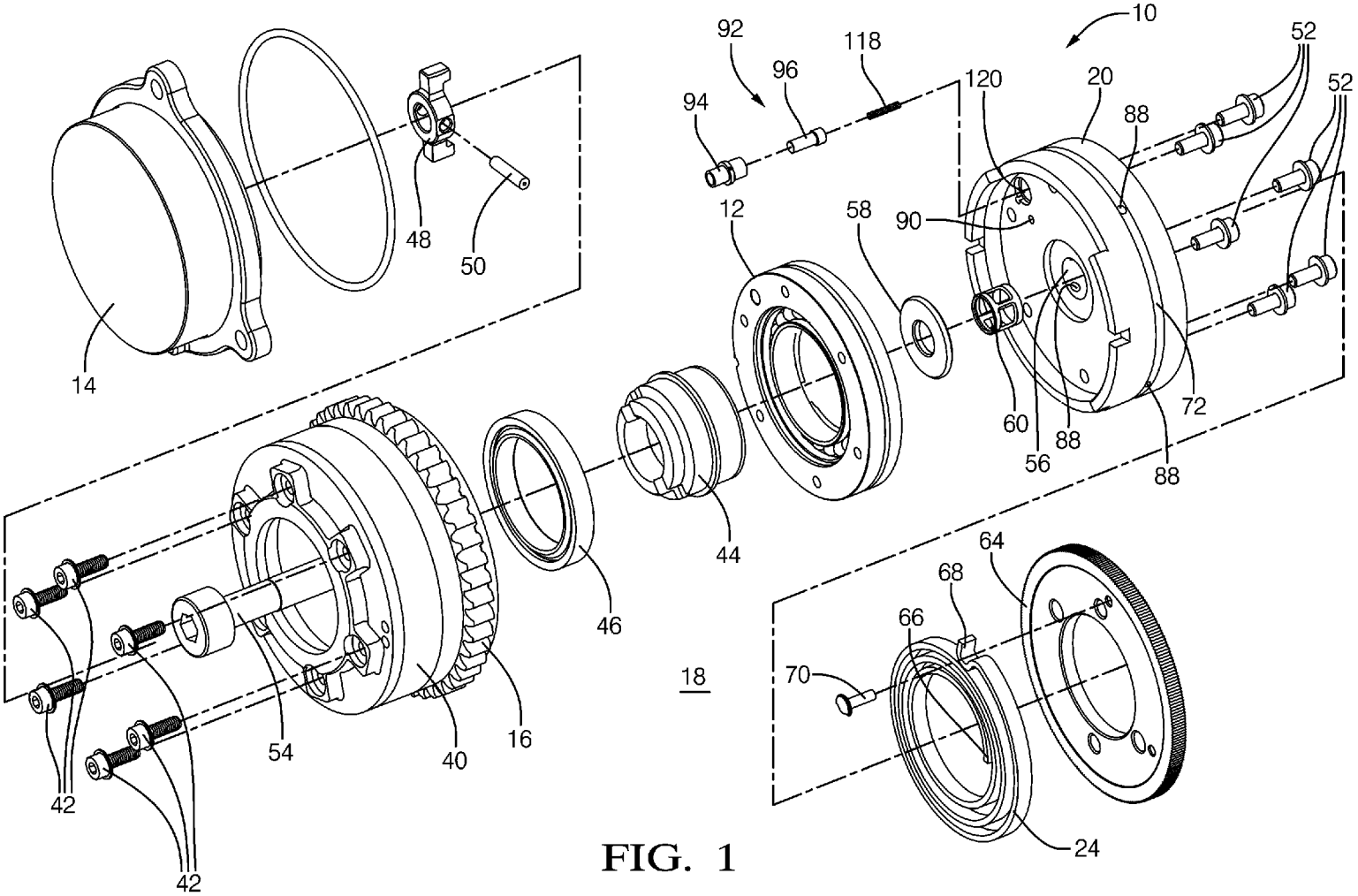
FIG. 1 is an exploded isometric view of an eVCP in accordance with the present invention.
Figure 2:
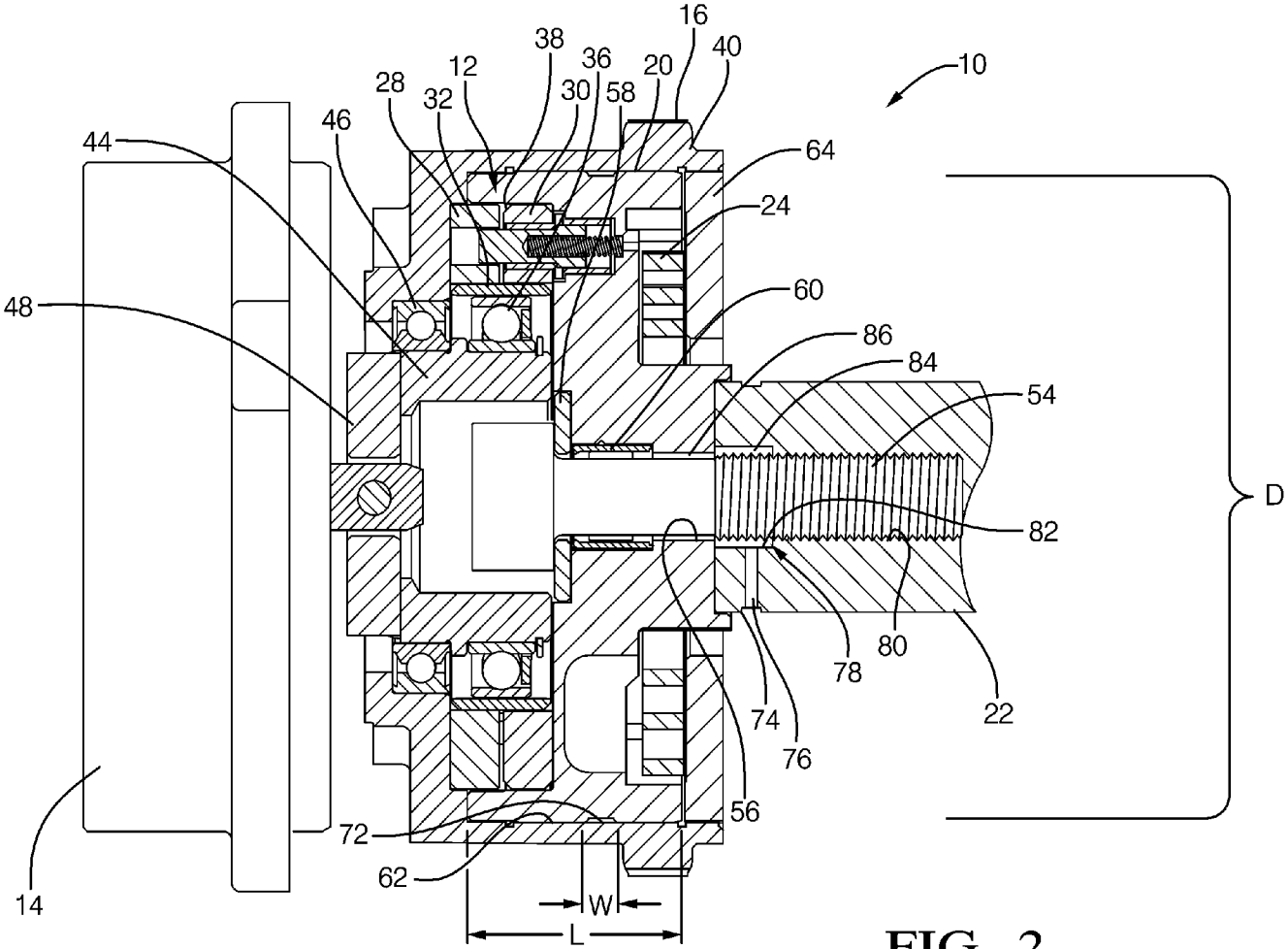
FIG. 2 is an axial cross-section of an eVCP in accordance with the present invention.
Figure 3:
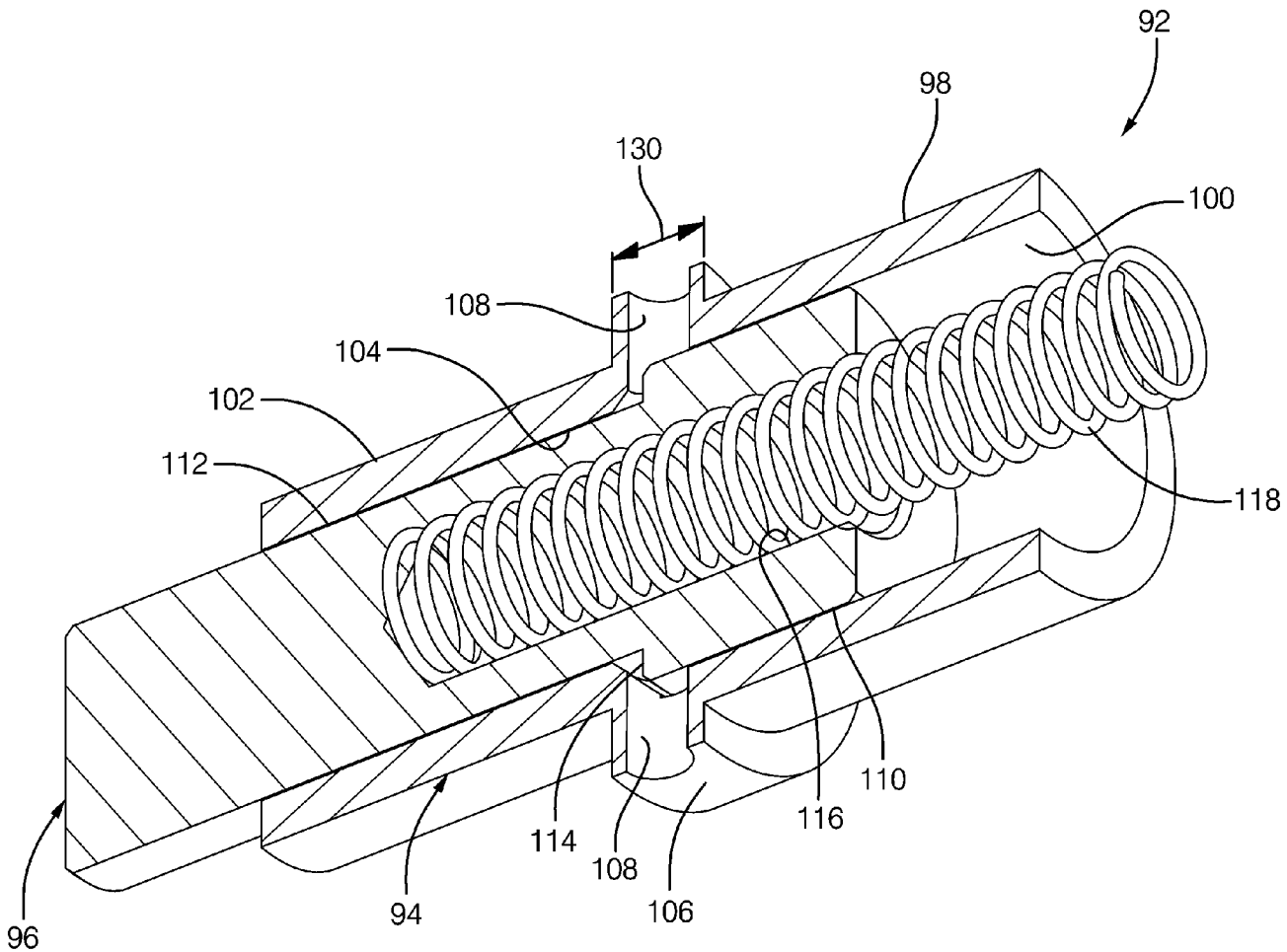
FIG. 3 is an enlarge isometric view of a lock pin assembly in accordance with the present invention.

Referring to FIGS. 1 and 2, eVCP 10 in accordance with the present invention comprises flat harmonic gear drive unit 12; rotational actuator 14 that may be a hydraulic motor but is preferably a DC electric motor, operationally connected to harmonic gear drive unit 12; input sprocket 16 operationally connected to harmonic gear drive unit 12 and drivable by a crankshaft (not shown) of internal combustion engine 18; output hub 20 attached to harmonic gear drive unit 12 and mountable to an end of camshaft 22 of internal combustion engine 18; and bias spring 24 operationally disposed between output hub 20 and input sprocket 16. Electric motor 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32.

Flexspline 32 is a non-rigid ring with external teeth on a slightly smaller pitch diameter than the circular spline. It is fitted over and elastically deflected by wave generator 36.

The circular spline is a rigid ring with internal teeth engaging the teeth of flexspline 32 across the major axis of wave generator 36.

The dynamic spline is a rigid ring having internal teeth of the same number as flexspline 32. It rotates together with flexspline 32 and serves as the output member. Either the dynamic spline or the circular spline may be identified by a chamfered corner 38 at its outside diameter to distinguish one spline from the other.

As is disclosed in the prior art, wave generator 36 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 36.

Of course, as will be obvious to those skilled in the art, the circular spline rather may have slightly more teeth than the dynamic spline has, in which case the rotational relationships described below are reversed.

Still referring to FIGS. 1 and 2, input sprocket 16 is rotationally fixed to a generally cup-shaped sprocket housing 40 that is fastened by bolts 42 to first spline 28. Coupling adaptor 44 is mounted to wave generator 36 and extends through sprocket housing 40, being supported by bearing 46 mounted in sprocket housing 40. Coupling 48 mounted to the motor shaft of electric motor 14 and pinned thereto by pin 50 engages coupling adaptor 44, permitting wave generator 36 to be rotationally driven by electric motor 14, as may be desired to alter the phase relationship between first spline 28 and second spline 30.

Output hub 20 is fastened to second spline 30 by bolts 52 and may be secured to camshaft 22 by camshaft phaser attachment bolt 54 extending through output hub axial bore 56 in output hub 20, and capturing thrust washer 58 and filter 60 recessed in output hub 20. In an eVCP, it is necessary to limit radial run-out between the input hub and output hub. Referring to FIG. 2, radial run-out is limited by a single journal bearing interface defining journal bearing 62 between sprocket housing 40 (input hub) and output hub 20, thereby reducing the overall axial length of eVCP 10 and its cost to manufacture.

Backplate 64 is press fit within sprocket housing 40 in order to retain output hub 20 within sprocket housing 40. Backplate 64 also captures bias spring 24 against output hub 20. Inner spring tang 66 of bias spring 24 is engaged by output hub 20, and outer spring tang 68 of bias spring 24 is attached to backplate 64 by pin 70. In the event of an electric motor malfunction, bias spring 24 is biased to back-drive harmonic gear drive unit 12 without help from electric motor 14 to a rotational position of second spline 30 wherein internal combustion engine 18 will start or run, which position may be at one of the extreme ends of the range of authority or intermediate of the camshaft phaser's extreme ends of its rotational range of authority. For example, the rotational range of travel in which bias spring 24 biases harmonic gear drive unit 12 may be limited to something short of the end stop position of the phaser's range of authority. Such an arrangement would be useful for internal combustion engines requiring an intermediate park position for idle or restart.

The nominal diameter of output hub 20 is D; the nominal axial length of journal bearing 62 is L; and the nominal axial length of oil groove 72 formed in either output hub 20 (shown) and/or in sprocket housing 40 (not shown) for supplying oil to journal bearing 62 is W. In addition to journal bearing clearance, the length L of journal bearing 62 in relation to output hub diameter D controls how much output hub 20 can tip within sprocket housing 40. The width of oil groove 72 in relation to journal bearing length L controls how much bearing contact area is available to carry the radial load. Experimentation has shown that a currently preferred range of the ratio L/D may be between about 0.25 and about 0.40, and that a currently preferred range of the ratio W/L may be between about 0.15 and about 0.70.

In order to lubricate various elements of eVCP 10, oil is provided thereto from internal combustion engine 18 through annular camshaft oil groove 74 supplied with oil by an oil gallery (not shown) of a camshaft bearing (also not shown).

Annular camshaft oil groove 74 provides oil to camshaft oil passage 76 which extends radially through camshaft 22 from annular camshaft oil groove 74 to camshaft bore 78 of camshaft 22. Camshaft bore 78 includes small diameter portion 80 which threadably engages camshaft phaser attachment bolt 54. Camshaft bore 78 also includes large diameter portion 82 which defines camshaft annular space 84 with camshaft phaser attachment bolt 54 that is adjacent to output hub 20. Camshaft annular space 84 receives the oil from camshaft oil passage 76. Camshaft annular space 84 is in fluid communication with output hub annular space 86 which is defined between output hub axial bore 56 and camshaft phaser attachment bolt 54. From output hub annular space 86, the oil passes through filter 60 to prevent contaminants from passing further into eVCP 10. Filter 60 is a band-type filter that may be a screen or mesh and may be made from any number of different materials that are known in the art of oil filtering. After passing through filter 60, the oil is communicated to journal bearing oil passages 88 which extend radially through output hub 20 from output hub axial bore 56 to oil groove 72 for lubricating journal bearing 62.

Oil may also used to lubricate harmonic gear drive unit 12 and bearing 46. In order to supply oil thereto, harmonic drive oil passage 90 is provided axially through output hub 20 beginning at one of the journal bearing oil passages 88 and extending toward harmonic gear drive unit 12 substantially parallel to the axis of rotation of eVCP 10. In this way, oil from journal bearing oil passage 88 is communicated to harmonic gear drive unit 12 and bearing 46.

Now referring to FIGS. 1-5, eVCP 10 includes lock pin assembly 92 in order to selectively prevent a change in phase relationship of the crankshaft relative to camshaft 22 at a predetermined phase relationship. Lock pin assembly 92 includes lock pin housing 94 for slidably receiving lock pin 96. Lock pin housing 94 includes cylindrical hub section 98 having hub section bore 100. Lock pin housing 94 also includes cylindrical spline section 102 having spline section bore 104. Cylindrical hub section 98 and hub section bore 100 are coaxial with cylindrical spline section 102 and spline section bore 104. Cylindrical hub section 98 and hub section bore 100 are larger in diameter than cylindrical spline section 102 and spline section bore 104 respectively. Lock pin housing flange 106 separates cylindrical hub section 98 from cylindrical spline section 102 and extends radially outward from cylindrical hub section 98 and cylindrical spline section 102. Lock pin housing flange 106 includes flange oil passages 108 extending radially through lock pin housing flange 106 for providing fluid communication from the outer surface of lock pin housing flange 106 to hub section bore 100.

Lock pin 96 includes larger diameter section 110 which is sized to interface with hub section bore 100 of lock pin housing 94 in a close sliding fit. Lock pin 96 also includes smaller diameter section 112 which is smaller in diameter than larger diameter section 110 and coaxial with larger diameter section 110 and which is sized to interface with spline section bore 104 of lock pin housing 94 in a close sliding fit. Lock pin shoulder 114 is the surface connecting larger diameter section 110 to smaller diameter section 112. Lock pin shoulder 114 may be substantially perpendicular to larger diameter section 110 and smaller diameter section 112 or may alternatively be inclined to larger diameter section 110 and smaller diameter section 112. Lock pin 96 also includes spring bore 116 which begins at the axial end of larger diameter section 110 and extends coaxially part way into lock pin 96 for receiving lock pin spring 118 therein.

Cylindrical hub section 98 and lock pin housing flange 106 of lock pin housing 94 are received within lock pin bore 120 of output hub 20. Lock pin bore 120 includes lock pin bore first section 122 for receiving cylindrical hub section 98. Lock pin bore first section 122 may sized to provide radial clearance with cylindrical hub section 98. Lock pin bore 120 also includes lock pin bore second section 124 for receiving lock pin housing flange 106. Lock pin bore second section 124 is coaxial with lock pin bore first section 122 and is sized to be larger in diameter than lock pin bore first section 122. Lock pin bore second section 124 may also be sized to provide radial clearance with lock pin housing flange 106. Lock pin bore shoulder 126 is the surface connecting lock pin bore first section 122 to lock pin bore second section 124. Lock pin bore second section 124 may have a depth 128 (shown in FIGS. 4A, 4B) which is substantially the same as or slightly less than a thickness 130 (shown in FIG. 3) of lock pin housing flange 106 to allow lock pin housing flange 106 to be clamped between lock pin bore shoulder 126 and second spline 30 to substantially prevent oil from leaking past the interface of lock pin bore shoulder 126 and lock pin housing flange 106 and the interface of second spline 30 and lock pin housing flange 106. Lock pin bore 120 may also include spring seat 132 which is defined by a bore extending axially away from the axial end of lock pin bore first section 122. Lock pin bore 120 may also include vent 134 which extends axially through output hub 20 beginning at spring seat 132 for providing fluid communication through output hub 20 from lock pin bore 120.

Cylindrical spline section 102 of lock pin housing 94 is received within second spline through bore 136 which extends axially through second spline 30. Second spline through bore 136 may be sized to interface with cylindrical spline section 102 with a close radial fit which may be either a close sliding fit or a press fit.

The radial clearance provided between lock pin bore first section 122 and cylindrical hub section 98 and between lock pin bore second section 124 and lock pin housing flange 106 allows for misalignment between lock pin bore 120 and second spline through bore 136. Misalignment between lock pin bore 120 and second spline through bore 136 may result, for example, from manufacturing variation. The radial clearance provided between lock pin bore first section 122 and cylindrical hub section 98 and between lock pin bore second section 124 and lock pin housing flange 106 also allows lock pin housing 94 to float radially within lock pin bore 120 during assembly of harmonic gear drive unit 12 to output hub 20 prior to bolts 52 being tightened. During assembly of harmonic gear drive unit 12 to output hub 20, bolts 52 may be threaded part way into second spline 30, but not yet fully tightened. Next, wave generator 36 may be rotated, thereby causing relative rotation between first spline 28 and second spline 30. This allows second spline 30 to find its natural alignment with output hub 20. Since there is radial clearance provided between lock pin bore first section 122 and cylindrical hub section 98 and between lock pin bore second section 124 and lock pin housing flange 106, allowance is made for misalignment between lock pin bore 120 and second spline through bore 136. Accordingly, lock pin assembly 92 does not interfere with second spline 30 finding its natural alignment with output hub 20. After second spline 30 has found is natural alignment with output hub 20, bolts 52 are fully tightened to secure second spline 30 to output hub 20, thereby clamping lock pin housing flange 106 between second spline 30 and lock pin bore shoulder 126.

First spline 28 includes lock pin seat 138 which extends axially into first spline 28 for selectively receiving a portion of smaller diameter section 112 therein. Lock pin seat 138 may extend through first spline 28 as shown. Alternatively, lock pin seat 138 may extend only axially part way into first spline 28 (not shown). Lock pin seat 138 may be sized to be slightly larger than smaller diameter section 112 in order to allow smaller diameter section 112 to be easily inserted into lock pin seat 138 when desired, while substantially preventing relative rotation between first spline 28 and second spline 30 when smaller diameter section 112 is received within lock pin seat 138. For example, relative rotation between first spline 28 and second spline 30 may be preferably limited to 1° when smaller diameter section 112 is received within lock pin seat 138. Even more preferably, relative rotation between first spline 28 and second spline 30 may be limited to 0.5° or less when smaller diameter section 112 is received within lock pin seat 138.

Figure 4A:
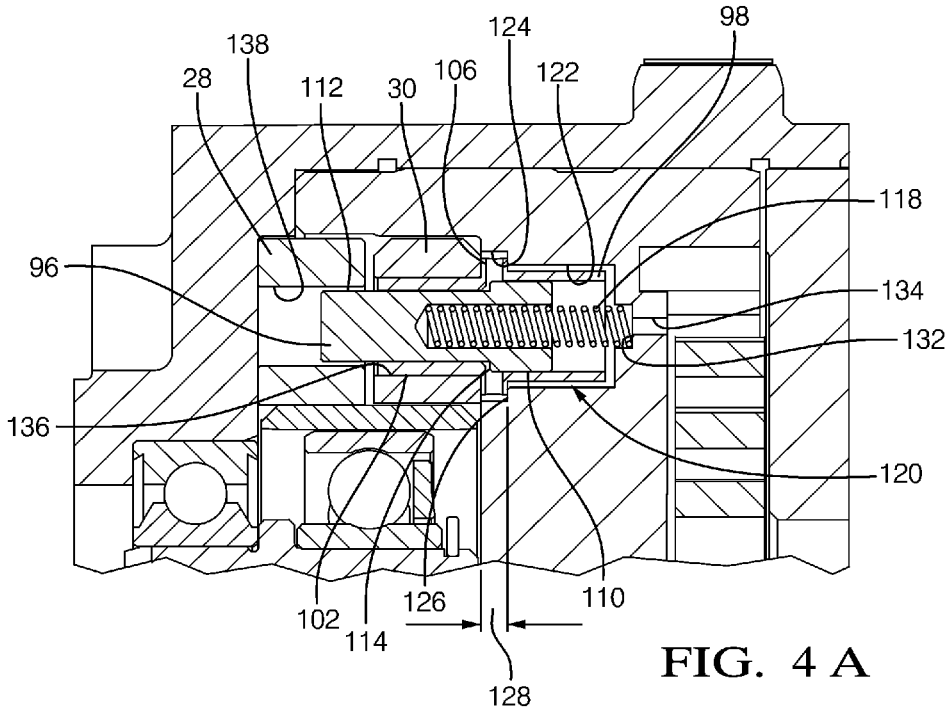
FIG. 4A is an enlarge view of circle 4 of FIG. 2 showing a lock pin engaged with a lock pin seat.
Figure 4B:
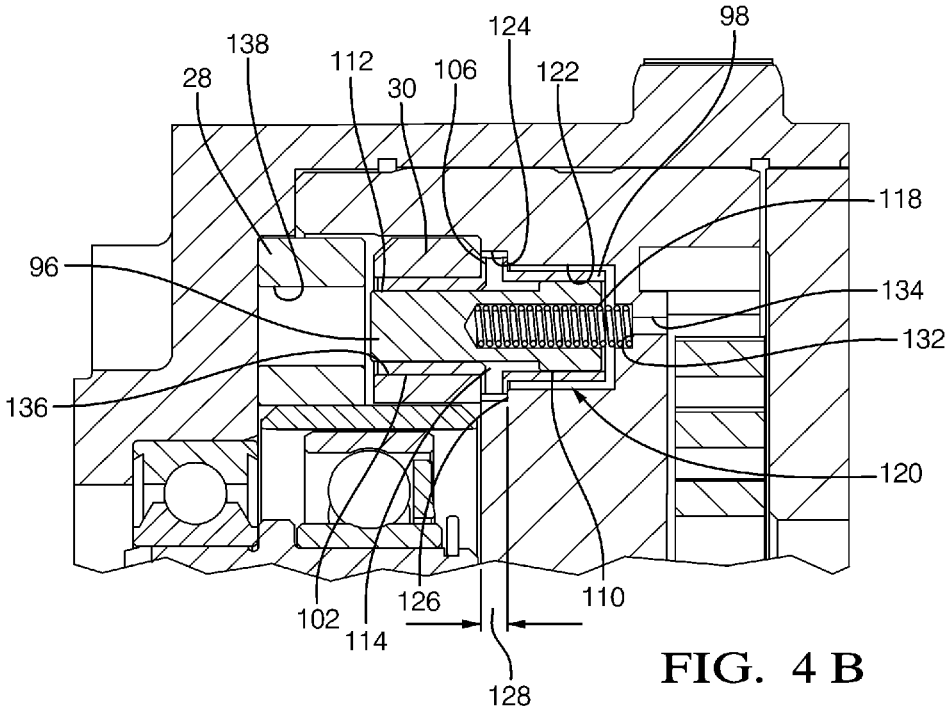
FIG. 4B is the enlarged view of FIG. 4A now showing the lock pin retracted from the lock pin seat.
Figure 5:
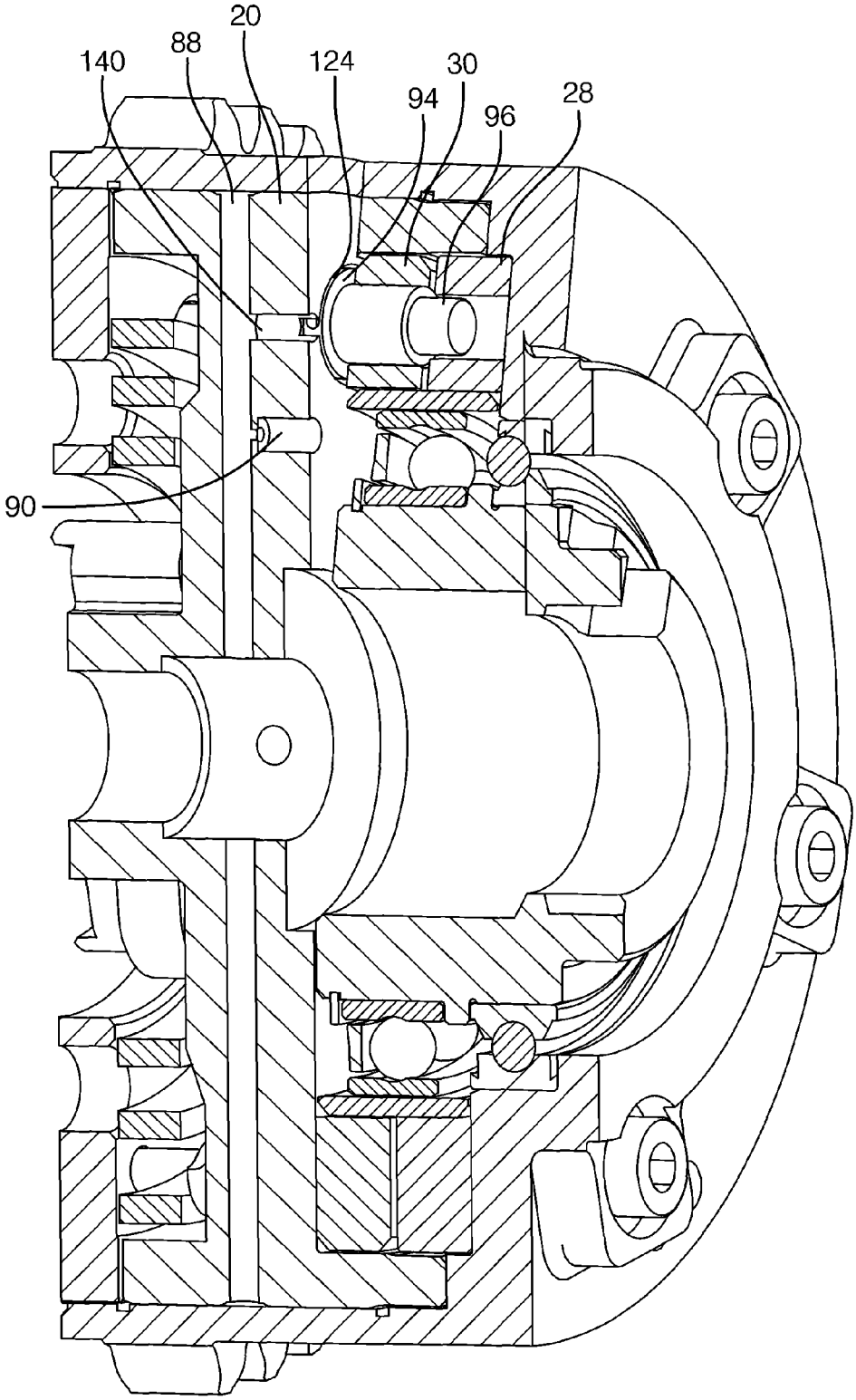
FIG. 5 is an axial cross-section of an eVCP in accordance with the present invention showing an oil path for actuating a lock pin in accordance with the present invention.

In order to retract smaller diameter section 112 from lock pin seat 138 as shown in FIG. 4B, a pressurized fluid, for example oil from internal combustion engine 18, is supplied to lock pin shoulder 114. In one example, pressurized oil for retracting smaller diameter section 112 from lock pin seat 138 may come from the same source used to lubricate journal bearing 62 and harmonic gear drive unit 12. In this example, lock pin oil passage 140 (shown in FIG. 5) extends from one of the journal bearing oil passages 88 to the radial face of lock pin bore second section 124 in order to supply pressurized oil from journal bearing oil passage 88 to lock pin bore second section 124. Lock pin oil passage 140 is truncated by second spline 30. From lock pin bore second section 124, the pressurized oil passes through flange oil passages 108 to reach and react upon lock pin shoulder 114. The pressurized oil acting on lock pin shoulder 114 causes smaller diameter section 112 to retract from lock pin seat 138, thereby compressing lock pin spring 118. Air and any oil that may leak past the interface between lock pin bore shoulder 126 and lock pin housing flange 106 may be vented through vent 134 in order to allow uninhibited retraction of smaller diameter section 112 from lock pin seat 138. With smaller diameter section 112 retracted from lock pin seat 138, relative rotation between first spline 28 and second spline 30 is possible, thereby allowing a change in phase relationship between camshaft 22 and the crankshaft as may be desired to obtain a desired operating condition of internal combustion engine 18.

In order to position smaller diameter section 112 within lock pin seat 138 as shown in FIG. 4A, the pressurized oil, is vented from lock pin shoulder 114. In order to vent the pressurized oil from lock pin shoulder 114, the supply of pressurized oil to journal bearing oil passages 88 is interrupted, for example, by an oil control valve (not shown) of internal combustion engine 18. When the supply of pressurized oil to journal bearing oil passages 88 is interrupted, the pressure of the oil within journal bearing oil passages 88 drops because the oil is bled off by leakage past journal bearing 62 and through harmonic drive oil passage 90. In this way, the pressure applied to lock pin shoulder 114 is not sufficient to resist the force of lock pin spring 118. Accordingly, lock pin spring 118 urges lock pin 96 toward first spline 28. If lock pin seat 138 is aligned with lock pin 96, a portion of smaller diameter section 112 is inserted within lock pin seat 138. If lock pin seat 138 is not already aligned with lock pin 96 when lock pin spring 118 urges lock pin 96 toward first spline 28, relative rotation between first spline 28 and second spline 30 will need to take place in order to align lock pin 96 with lock pin seat 138. Relative rotation between first spline 28 and second spline 30 may result from at least one of actuation of electric motor 14, urging by bias spring 24, and forces from the valve train of internal combustion engine 18.

While not shown, it should now be understood that cylindrical spline section 102 of lock pin housing 94 may be eliminated. In this alternative arrangement, second spline through bore 136 is sized to interface with smaller diameter section 112 in a close sliding fit relationship.

While the embodiment described herein uses the same pressurized oil source to actuate lock pin 96 as is used to lubricate journal bearing 62 and bearing 46, a separate oil supply (not shown) may be used to actuate lock pin 96. This would allow pressure to be relieved from lock pin 96 while still providing lubrication to journal bearing 62 and bearing 46 in order to engage lock pin 96 with lock pin seat 138 while internal combustion engine 18 is still running. Additionally, it may be desirable to retract lock pin 96 from lock pin seat 138 when pressurized oil from internal combustion engine 18 is not available to retract lock pin 96 from lock pin seat 138. This may occur, for example, when internal combustion engine 18 is not running or just after internal combustion engine 18 has been started but before internal combustion engine 18 is able to supply pressurized oil to eVCP 10. In order to provide pressurized oil to lock pin 96 when pressurized oil from internal combustion engine 18 is not available, an accumulator (not shown) may be provided to store a charge of pressurized oil that can be released when desired for retracting lock pin 96 from lock pin seat 138.

The embodiment described herein describes harmonic gear drive unit 12 as comprising outer first spline 28 which may be either a circular spline or a dynamic spline which serves as the input member; an outer second spline 30 which is the opposite (dynamic or circular) of first spline 28 and which serves as the output member and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32. As described, harmonic gear drive unit 12 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inwards of the circular spline and having outwardly-extending gear teeth disposed for engaging inwardly-extending gear teeth on the circular spline; and a wave generator disposed radially inwards of and engaging the flexspline.

While this invention has been described in terms of preferred embodiments thereof, it is not intended to be so limited, but rather only to the extent set forth in the claims that follow.

I claim:

1. A camshaft phaser for controllably varying the phase relationship between a crankshaft and a camshaft in an internal combustion engine, said camshaft phaser comprising:

a housing having a longitudinal axis;

a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, and a rotational actuator connectable to said wave generator such that rotation of said wave generator causes relative rotation between said circular spline and said dynamic spline, wherein one of said circular spline and said dynamic spline is fixed to said housing in order to prevent relative rotation therebetween;

a hub rotatably disposed within said housing axially adjacent to said harmonic gear drive unit and attachable to said camshaft and fixed to the other of said circular spline and said dynamic spline in order to prevent relative rotation therebetween;

a lock pin slidingly disposed in a lock pin bore of said hub and also slidingly disposed in a through bore of either said circular spline or said dynamic spline for selective engagement with a lock pin seat disposed in the other of said circular spline and said dynamic spline, wherein engagement of said lock pin with said lock pin seat prevents relative rotation between said circular spline and said dynamic spline, said lock pin bore having a stepped shape with a lock pin bore first section and a lock pin bore second section adjacent to said lock pin bore first section, wherein said lock pin bore first section is smaller in diameter than said lock pin bore second section; and a lock pin housing disposed within said lock pin bore, wherein said lock pin housing includes a cylindrical hub section disposed within said lock pin bore first section, wherein said lock pin housing includes a lock pin housing flange extending radially outward from said cylindrical hub section, said lock pin housing flange being disposed within said lock pin bore second section, and wherein said lock pin is disposed within said lock pin housing with a close sliding fit.

2. A camshaft phaser as in claim 1 wherein radial clearance is formed between said cylindrical hub section and said lock pin bore first section, and wherein radial clearance is formed between said lock pin housing flange and said lock pin bore second section.

3. A camshaft phaser as in claim 1 wherein a lock pin bore shoulder is formed between said lock pin bore first section and said lock pin bore second section, and wherein said lock pin housing flange is clamped between said lock pin bore shoulder and said one of said circular spline and said dynamic spline.

4. A camshaft phaser as in claim 3 wherein said lock pin housing also includes a cylindrical spline section separated from said cylindrical hub section by said lock pin housing flange, said cylindrical spline section being disposed within said through bore of said one of said circular spline and said dynamic spline with a close radial fit.

5. A camshaft phaser as in claim 1 wherein said lock pin includes a larger diameter section and a smaller diameter section, said larger diameter section being sliding disposed concentrically within said cylindrical hub section of said lock pin housing with a close sliding fit.

6. A camshaft phaser as in claim 5 wherein a lock pin shoulder is formed between said larger diameter section and said smaller diameter section.

7. A camshaft phaser as in claim 6 further comprising a fluid passage for selectively supplying a fluid to said lock pin and for draining said fluid from said lock pin, wherein supplying said fluid to said lock pin retracts said lock pin from said lock pin seat and draining said fluid from said lock pin engages said lock pin with said lock pin seat.

8. A camshaft phaser as in claim 7 wherein at least a portion of said fluid passage is a flange oil passage extending radially through said lock pin housing flange.

9. A camshaft phaser as in claim 1 wherein said hub includes a vent extending axially therethrough for providing fluid communication with said lock pin bore first section.

10. A camshaft phaser as in claim 1 further comprising a lock pin spring for biasing said lock pin toward said lock pin seat.

11. A camshaft phaser for controllably varying the phase relationship between a crankshaft and a camshaft in an internal combustion engine, said camshaft phaser comprising:

a housing having a longitudinal axis;

a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, and a rotational actuator connectable to said wave generator such that rotation of said wave generator causes relative rotation between said circular spline and said dynamic spline, wherein one of said circular spline and said dynamic spline is fixed to said housing in order to prevent relative rotation therebetween;

a hub rotatably disposed within said housing axially adjacent to said harmonic gear drive unit and attachable to said camshaft and fixed to the other of said circular spline and said dynamic spline in order to prevent relative rotation therebetween;

a lock pin for selective engagement with a lock pin seat wherein engagement of said lock pin with said lock pin seat prevents relative rotation between said circular spline and said dynamic spline; and a fluid passage for selectively supplying a fluid to said lock pin and for draining said fluid from said lock pin, wherein supplying said fluid to said lock pin retracts said lock pin from said lock pin seat and draining said fluid from said lock pin engages said lock pin with said lock pin seat.

* * * * *